United States Patent [19]

Brazzale

[11] 4,322,866

[45] Apr. 6, 1982

[54] POLISHER MOUNTING MEANS

[75] Inventor: Gina Brazzale, Norwood, South Australia, Australia

[73] Assignee: Anthony John Brazzale, Norwood, South Australia, Australia

[21] Appl. No.: 160,982

[22] Filed: Jun. 19, 1980

[51] Int. Cl.[3] ..... A46B 13/02

[52] U.S. Cl. ..... 15/180; 15/230; 15/98

[58] Field of Search ..... 15/180, 230, 230.18, 15/230.12, 230.17, 98

[56] References Cited

U.S. PATENT DOCUMENTS

| | | | |
|---|---|---|---|
| 3,464,075 | 9/1969 | Sullivan | 15/98 |
| 3,742,550 | 7/1973 | Wakefield | 15/230 |

FOREIGN PATENT DOCUMENTS

| | | | |
|---|---|---|---|
| 165923 | 11/1955 | Australia | 15/180 |
| 941765 | 11/1963 | United Kingdom | 15/180 |
| 2016324 | 9/1979 | United Kingdom | 15/230 |

*Primary Examiner*—Peter Feldman
*Attorney, Agent, or Firm*—Jay L. Chaskin

[57] ABSTRACT

A floor polisher mounting means for mounting a floor polisher brush or pad to a coupling on the shaft of a floor polisher, comprises a disc of elastomeric material with a thick central zone and a thin peripheral zone, a metal boss on the central zone for mounting to the coupling means, and a metal mounting on the peripheral zone for coupling to the polisher brush.

9 Claims, 3 Drawing Figures

POLISHER MOUNTING MEANS

This invention relates to improvements in the mounting of a polisher brush or pad to a driving shaft or coupling means carried thereon, in a floor polisher.

BACKGROUND OF THE INVENTION

In some floor polishers, the driving shaft for the polisher pad has coupling means thereon and the polisher pad is directly secured to the coupling means. However, this is subject to certain disabilities. Firstly a harshness is transmitted by the machine to the operator (due to high frequency vibration) and secondly, there is difficulty in maintaining an even pressure over a wide area of brush or polisher pad.

Considerable improvements have been made by utilising two comparatively rigid discs which are joined together by a slab of comparatively resilient foam material, for example polyurethane foam, and this has been found to have the effect of substantially eliminating transmission of high frequency (harsh) vibrations, and also enabling the floor polishing brush or pad to maintain a relatively large area in contact with a floor even when the machine is tilted through a few degrees, for example, by a partly skilled operator. However, the soft resilience of foam material has given rise to further problems, the foam material being very easily damaged, for example by encountering the cord of the polisher, or the possibility of one of the two discs warping, or the discs not lying parallel to one another, and imparting unstable conditions to a brush. Difficulty has also been encountered with the effectiveness of the glue interfaces between the upper and lower surfaces of the foam and the respective discs. Another problem which has been encountered with the use of soft polystyrene mounting means has been the tendency for "wobble" to occur in a machine. When a polisher is needed for scrubbing, any wetting of the foam causes it to lose some of its resilience and to quickly deteriorate.

A series of experiments have indicated that there is a need to have a degree of resilience so that an operator can tilt a machine through a few degrees without losing area of contact of the polishing brush or pad with the floor surface. On the other hand, it is necessary to have sufficient stiffness to "iron out" wobbles as they tend to develop.

BRIEF SUMMARY OF THE INVENTION

In this invention there is provided a polisher mounting means for mounting a floor polisher brush or pad to coupling means on a floor polisher shaft, comprising:

a discoid member formed of elastomeric material having a relatively thick central zone and a relatively thin peripheral zone, a central metal boss on the discoid member embodying attachment means co-operable with said coupling means, and securing means for securing said brush or pad to said peripheral zone.

High frequency vibrations are absorbed by the elasotmeric material with an effectiveness which is comparable to that of the soft resilient foam which has been used heretofore, but more importantly, the large hysterisis characteristic of the elastomeric material which is used has the effect of snubbing low frequency vibrations as they tend to develop, which otherwise cause the machine to wobble, and the invention is found to be surprisingly effective in providing very smooth running which is easily handled. If the elastomeric material is rubber, it will be found to have an excellent deadening effect on vibrations which otherwise impart noise.

In some instances the discoid member merely functions as a backup for a brush which has a substantially rigid discoid base, while in other instances the discoid member is provided with engagement means, for example for the engaging of the fibrous or sponge type of pad.

BRIEF DESCRIPTION OF THE DRAWINGS

An embodiment of the invention is described hereunder in some detail with reference to and as illustrated in the accompanying drawings, in which.

Figure 3:
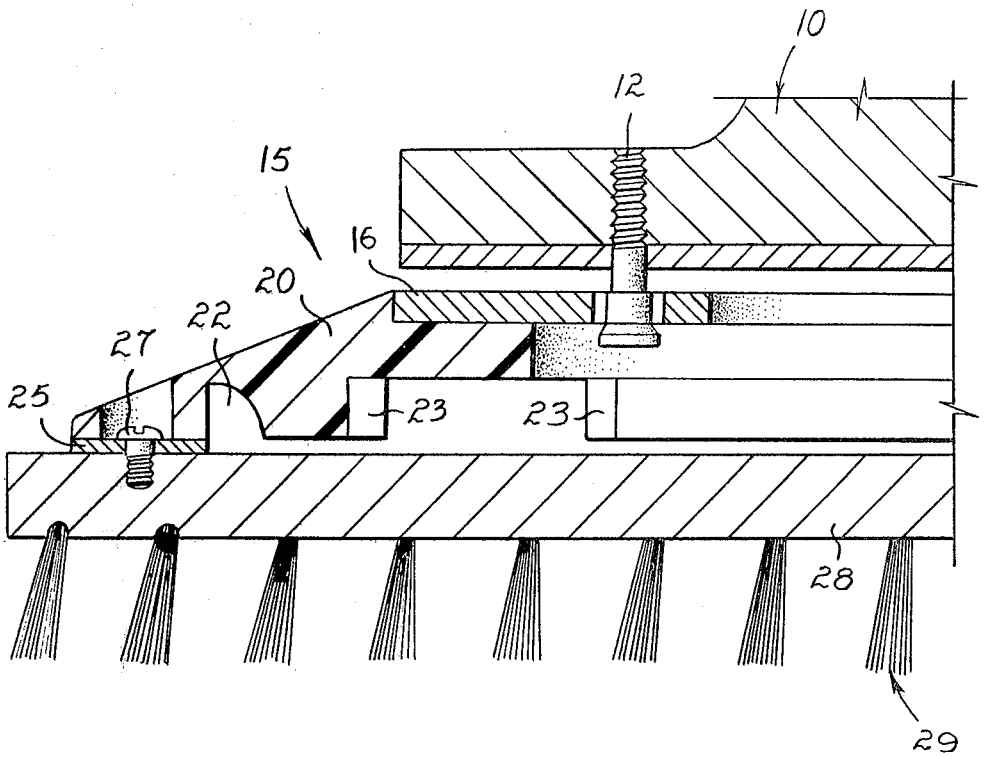
FIG. 3 is a fragmentary section, drawn to an enlarged scale illustrating the mounting of a floor polisher brush.

A typical coupling means for a floor polisher pad or brush can be identified in the specification of our Australian Pat. No. 478,254 and FIG. 3 herein is a simplified drawing of the arrangement shown therein.

In this embodiment, a floor polisher (not shown) is provided with coupling means 10 on an output shaft (not shown), substantially in accordance with said Australian Pat. No. 478,254. This includes three "necked" mounting pins 12 arranged on a pitch circle. Between the coupling means 10 and brush 29 (or a polisher pad) there is provided polisher mounting means 15 which comprises an intermediate discoid member, and it is the intermediate discoid member which provides the improvements of this invention.

The discoid member 15 comprises a central metal boss 16 having a central aperture 17 surrounded by apertures 18 on a pitch circle, so that it releasably engages the mounting pin 12 on the output shaft of the polisher, and the metal boss 16 has moulded to it an annular portion 20 formed from elastomeric material, in this embodiment being a natural rubber having a durometer hardness of between 60 and 90 (Shore A). There is a relationship between the durometer hardness and thickness, and this can best be determined empirically, but one suitable durometer hardness is found to be between 70 and 80 (Shore A).

Figure 1:
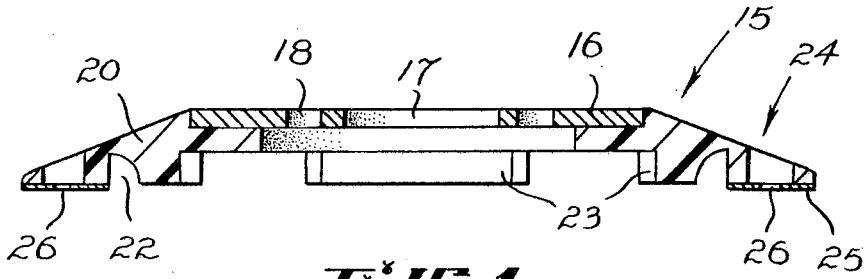
FIG. 1 is a central section through the mounting means.

The central zone is relatively thick, but on the underside of the central zone there is provided a part annular recess 22 concentric about the axis of rotation, and defining a respective radially outer wall of each of four circumferential pads 23 (although a single, or radially divided pad can be used). The thick central zone grades down through an intermediate to a relatively thin peripheral zone 24 as shown best in FIG. 1. The projections 23 will bear against the upper surface of a brush backing plate upon excessive distortion of the annular portion 20.

Figure 2:
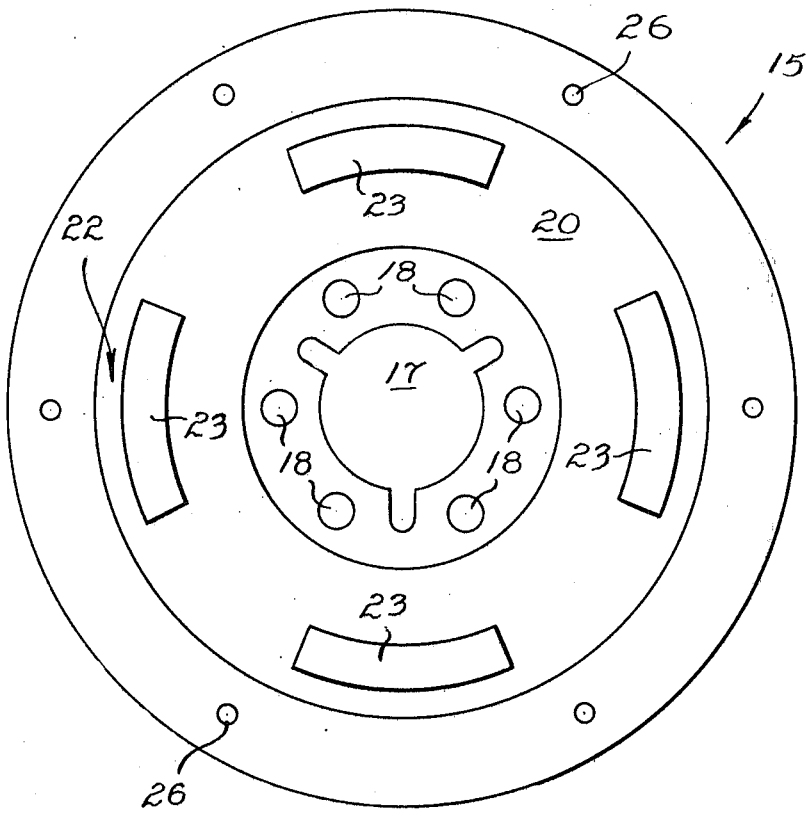
FIG. 2 is an underside view of same.

The under side of zone 24 is reinforced with a thin annular washer like metal member 25 containing a plurality of fastener apertures 26 (FIG. 2) which receive screws 27 (FIG. 3) by which the backing plate 28 of brush 29 is secured.

Alternatively, although not shown herein, the undersurface of the discoid member can have projecting therefrom, pad engaging means, for example being of the hooked fibrous type sold under the Trade Mark "VELCRO", or alternatively the nonhooked fibrous type sold under the Trade Mark "INSTALOCK". Either of these types of engagement means will engage a fibrous pad.

In a slight variation of the above embodiment, the thick central zone contains a plurality of undercut recesses which receive respective inserts, each insert being formed from a relatively hard plastics material, for example nylon, and having a plurality of outwardly projecting and forwardly sloping pins which will also engage a fibrous pad. In this alternative embodiment the inserts are arranged to extend radially outwardly although their arrangement can be varied if required. However, by extending radially outwardly they are readily removed from their slots by moving across the axis of rotation into the outer of the two annular recesses on the undersurface of the discoid member.

The cross-sectional shape can be varied to suit different requirements. The upper surface can for example be concave or convex, and the discoid member can be associated with a thickened outer peripheral portion, or alternatively, the outer peripheral portion of greater rigidity.

The hysteresis of the natural rubber which is used is found to absorb much of the shock, and to snub the development of "wobble" (low frequency excursions of movement away from a mean) without so stressing the discoid member that breakdown is likely to occur. However, It is necessary to have a durometer hardness of less than 90 in most instances in order to achieve the required degree of resilience. The mounting means will be seen to be constituted by a single unit, and this can be constructed of such high quality material that maintenance is minimal.

Various modifications in structure and/or function may be made by one skilled in the art to the disclosed embodiments without departing from the scope of the invention as defined by the claims.

What is claimed is:

1. Polisher mounting means for mounting a floor polisher brush or pad to coupling means on a floor polisher shaft, comprising:

an annular discoid member formed of elastomeric material having a durometer hardness of between 60 and 90 (shore A), the discoid member having a relatively thick central zone which grades down through an intermediate zone to a peripheral zone, and is relatively thin where the intermediate zone joins the peripheral zone, a central metal boss on the central zone of the discoid member embodying attachment means cooperable with the coupling means, a thin annular metal member on the underside of the discoid member and extending around the peripheral zone, and securing means for securing the brush or pad to the annular metal member.

2. Polisher mounting means according to claim 1 wherein the undersurface of the discoid member includes an annular recess located where the intermediate zone joins the peripheral zone.

3. Polisher mounting means according to claim 1 wherein the undersurface of the central zone includes at least one projection, the recess defining a radial outer wall of the projection.

4. Polisher mounting means according to claim 3 wherein there are a plurality of circumferentialy spaced projections.

5. Polisher mounting means according to claim 4 wherein the projection will bear against an upper surface of the brush upon distortion of the shape of the discoid member.

6. Polisher mounting means according to claim 1 wherein said central metal boss is a disc of metal on the upper surface of the discoid member and having a central aperture surrounded by a plurality of further apertures circumferentially arranged around the central aperture on a pitch circle.

7. Polisher mounting means according to claim 1 or claim 2 wherein the wall thickness of said discoid member grades in a radial direction from said relatively thick central zone to said relatively thin peripheral zone.

8. Polisher mounting means according to claim 1 or claim 2 wherein the underface of said discoid member has at least one projection projecting downwardly between two of said zones, and being of such dimension as to bear against the upper surface of a backing plate of a brush when attached to the discoid member upon distortion of shape of the discoid member.

9. Polisher mounting means according to claim 1 or claim 2 wherein said securing means comprise fastening screws extending through apertures in the annular metal member for fastening a brush backing plate thereto.

* * * * *